US005553957A

United States Patent [19]

Dornbusch et al.

[11] Patent Number: 5,553,957

[45] Date of Patent: Sep. 10, 1996

[54] PRODUCT DISPENSER WITH ENLARGED NON-DISPENSING APPLICATION/DISTRIBUTION SURFACE

[75] Inventors: Arthur H. Dornbusch, Cincinnati; Dianna C. Kenneally, Maineville; JoAnn L. Taylor, Trenton, all of Ohio

[73] Assignee: The Procter & Gamble Company, Cincinnati, Ohio

[21] Appl. No.: 550,547

[22] Filed: Nov. 7, 1995

Related U.S. Application Data

[63] Continuation of Ser. No. 209,032, Mar. 9, 1994, abandoned.

[51] Int. Cl.[6] ..... A45D 34/04

[52] U.S. Cl. ..... 401/209; 401/21; 401/213; 401/216

[58] Field of Search ..... 401/208, 209, 401/213, 216, 21

[56] References Cited

U.S. PATENT DOCUMENTS

| | | | |
|---|---|---|---|
| 1,164,848 | 12/1915 | Neukirchen . | |
| 1,977,414 | 10/1934 | Testa | 401/213 |
| 2,081,673 | 5/1937 | Olson . | |
| 2,598,493 | 5/1952 | Bogin et al. | 15/132.7 |
| 2,641,788 | 6/1953 | Sudbeaz | 401/216 |
| 2,685,099 | 8/1954 | Tonge | 401/21 |
| 2,700,784 | 1/1955 | DeBrock | 401/213 |
| 2,883,690 | 4/1959 | Holler, Jr. | 401/213 |
| 2,981,968 | 5/1961 | Schaich | 15/572 |
| 3,036,328 | 5/1962 | Schaich | 15/572 |
| 3,039,132 | 6/1962 | Hambley | 401/220 |
| 3,055,041 | 9/1962 | Schaich | 401/213 |
| 3,081,769 | 3/1963 | Ackerman | 128/65 |
| 3,100,908 | 8/1963 | Engle . | |
| 3,235,900 | 2/1966 | Klassen | 15/558 |
| 3,912,403 | 10/1975 | Gjerloff | 401/176 |
| 4,037,977 | 7/1977 | Ronai | 401/209 |
| 4,050,826 | 9/1977 | Berghahn et al. | 401/196 |

(List continued on next page.)

FOREIGN PATENT DOCUMENTS

| | | | |
|---|---|---|---|
| 1207278 | 7/1986 | Canada | 401/213 |
| 2700647 | 7/1978 | Germany | 401/21 |
| 3402614 | 8/1985 | Germany . | |
| 232036 | 4/1925 | United Kingdom . | |
| 496670 | 12/1938 | United Kingdom . | |
| 2082124 | 3/1982 | United Kingdom | 401/209 |
| 2195296 | 4/1988 | United Kingdom | 401/213 |

*Primary Examiner*—Steven A. Bratlie
*Attorney, Agent, or Firm*—William Scott Andes; Daniel F. Nesbitt

[57] ABSTRACT

The present invention relates to improved product dispensers for various spreadable products, including fluids, suspensions, lotions, creams, emulsions, and gels. In a preferred embodiment of the present invention, the dispenser is in the form of an improved roll-on type applicator with an enlarged application/distribution surface in the form of a dome with an aperture for exposing a portion of the rotating element. As product is expressed from the gap between the element and dome, it follows the surface of the element into contact with the desired surface and is thereby applied to this surface. Excess product not applied to the desired surface by the element either follows the element surface through the gap between the element and the dome back into the container or is sheared from the element surface by the edge of the aperture in the dome. This sheared-off product flows onto the dome surface or contacts other pans of the desired receiving surface and is distributed by the application/distribution surface of the dome, which functions both as a secondary applicator for this undistributed product and as a primary distributor for evening out the total product distribution on the desired surface, thus providing an improved means of uniformly applying and distributing product dispensed by the rotating element. The resulting roll-on applicator enables the product to be more easily applied in a consistent, less messy fashion, and the simplicity of the package construction equates to a very user-friendly package which is cost effective to produce and reliable in operation.

17 Claims, 2 Drawing Sheets

U.S. PATENT DOCUMENTS

| | | | |
|---|---|---|---|
| 4,168,128 | 9/1979 | Fillmore et al. | 401/216 |
| 4,221,494 | 9/1980 | Kachur | 401/213 |
| 4,221,495 | 9/1980 | Braun et al. | 401/213 |
| 4,475,837 | 10/1984 | Dornbusch et al. | 401/213 |
| 4,708,267 | 11/1987 | Sieverding et al. | 222/211 |
| 4,887,924 | 12/1989 | Green | 401/261 |
| 5,051,017 | 9/1991 | Yorks | 401/209 |
| 5,073,057 | 12/1991 | Lathrop et al. | 401/206 |
| 5,275,496 | 1/1994 | Fattori et al. | 401/68 |

PRODUCT DISPENSER WITH ENLARGED NON-DISPENSING APPLICATION/DISTRIBUTION SURFACE

This is a continuation of application Ser. No. 08/209,032, filed on Mar. 9, 1994, now abandoned.

FIELD OF THE INVENTION

The present invention relates to improved product dispensers for various spreadable products, including fluids, suspensions, lotions, creams, emulsions, and gels. More particularly, the present invention relates to improved roll-on applicators of the type which include an enlarged non-dispensing application/distribution surface surrounding a rotating element for the purpose of providing an improved means of uniformly applying and distributing product dispensed by the rotating element.

BACKGROUND OF THE INVENTION

Of the various dispenser types available for dispensing various spreadable products (including fluids, suspensions, lotions, creams, emulsions, and gels) and applying them to a surface, one widely used type of dispenser is a roll-on type of applicator. In this type of dispenser, a rotating element (often spherical or cylindrical) is in fluid communication with a product reservoir within the package. When the rotating element is drawn across the desired surface, a film of product having a predetermined thickness is drawn out of the dispenser on the surface of the rotating element. The thickness of this film is controlled by a number of factors, including the clearance between the element surface and the element-capturing portion of the package and the viscosity of the product. As the rotating element rolls over the surface, the film of product is applied to the surface along the contact path of the element.

Current commercially available roll-on packages utilize the rotating element to not only apply the product to the desired area, but also to perform the metering/dispensing function. If a consumer utilizes the element to further distribute product already applied, additional product continues to be dispensed as the element rotates within its socket. This tends to result in uneven, generally wet and messy applications with wasted product.

Current commercially available packages also tend to have a comparatively large percentage of the rotating element's surface area exposed outside of the package, often on the order of 40–45%. The actual contact area of the element in conjunction with most surfaces is much less, on the order of 20–25%. Thus, while a comparatively large element is utilized to reduce the curvature of the contact surface, the remaining exposed surface is carrying forth a film of the product which cannot be applied to a corresponding surface and hence must either follow the element back inside the container or else build up a thicker film on this non-contacting exposed surface which is oriented 90° to the direction of travel of the rotating element. This thicker film, as well as excess product sheared from the surface of the element by the fitment, tends to form ridges of heavy product application at either side of the path the element travels across the desired surface. The sheared-off excess product may even ooze over the edge of the fitment holding the element. The large rotating surface also tends to attract threadlike elements such as loose threads, fuzz, or hair which may be present on the desired surface, and to draw them into the clearance space between the rotating element and the fitment.

Accordingly, it would be desirable to provide a roll-on type product dispenser which is easy to use and provides for a more even, less messy application of the product. It would also be desirable to provide a roll-on type dispenser which exhibits a reduced tendency to attract and capture loose threadlike elements which may be present on the desired surface for application.

SUMMARY OF THE INVENTION

The present invention provides an improved roll-on type applicator with an enlarged application/distribution surface in the form of a dome with an aperture for exposing a portion of the rotating element. In this configuration, much less of the element is exposed than with a conventional package, as the element's primary function is now only to supply the product.

As product is expressed from the gap between the element and dome, it follows the surface of the element into contact with the desired surface and is thereby applied to this surface. Excess product not applied to the desired surface by the element either follows the element surface through the gap between the element and the dome back into the container or is sheared from the element surface by the edge of the aperture in the dome. This sheared-off product flows onto the dome surface or contacts other parts of the desired receiving surface and is distributed by the application/distribution surface of the dome, which functions both as a secondary applicator for this undistributed product and as a primary distributor for evening out the total product distribution on the desired surface.

In addition to performing the application/distribution function, the dome may also function as a socket-type element holder and may be removable from the container, thus promoting refillability of the package. In this fashion, the dome may be removed from the neck of the container to provide access to the interior of the container via the open neck. Additional product from a conventional container may be poured into the roll-on package and the dome re-installed for continued use, or the dome may be installed on a substitute roll-on container.

In its role as the element holder, the socket portion of the dome also provides an improved means of metering product flow in addition to the gap between the element and the dome surface. The socket-based metering may include a surface texture or grooving of pre-determined size to permit product to pass by the socket surfaces onto the surface of the element, a feature particularly useful in accomodating a wide range product consistencies such as lotions or creams. Roll-on applicators according to the present invention may incorporate a multiple-metering system, i.e., having sequential or serial metering of product. For example, one level of metering may be provided by the gap between the inner surface of the container and the element, another level may be provided by the clearance between the element and the socket portion of the dome, and still another level of metering may be provided by the gap between the edge of the aperture and the element surface.

The resulting roll-on applicator enables the product to be more easily applied in a consistent, less messy fashion, and is also designed to allow for refillability while maintaining a four-piece package. The simplicity of the package construction equates to a very user-friendly package which is cost effective to produce and reliable in operation.

BRIEF DESCRIPTION OF THE DRAWINGS

The present invention will be better understood with reference to the following Detailed Description and to the accompanying Drawing Figures, in which.

Unless otherwise indicated, like elements are identified by like numerals throughout the Drawing Figures

DETAILED DESCRIPTION OF THE INVENTION

Figure 1:
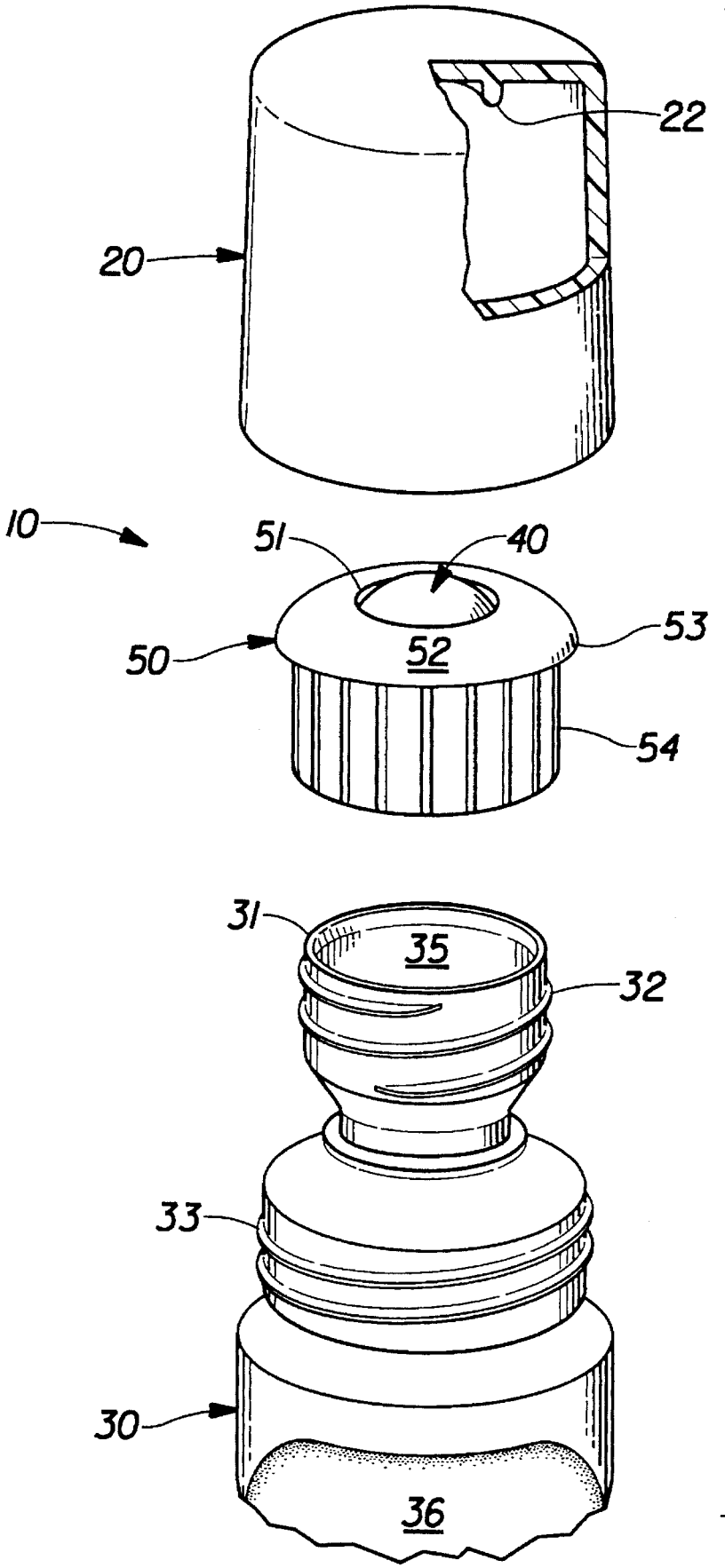
FIG. 1 is a fragmentary, exploded, perspective view of a preferred embodiment of the present invention, partially broken away and sectioned for clarity.

FIG. 1 depicts an improved roll-on applicator according to the present invention, denoted generally by the numeral 10. The roll-on applicator 10 includes four individual components: an overcap 20; a container 30; an applicator element 40; and an apertured dome 50.

The overcap 20 is generally cup-shaped, and encloses the applicator element and the apertured dome 50 during periods of non-use. The overcap 20 also includes a threaded portion (not shown) for securing the overcap to the container 30. On the underside of the central portion of the overcap a rib 22 is provided, the significance of which will be discussed below.

The container 30 is of generally conventional design, and includes a finish 31, a threaded portion 32 on the outer surface of the finish 31, and a second threaded portion 33. The interior 35 of the container 30 contains the liquid product (not shown). The body portion 36 of the container may be of any overall shape consistent with ergonomic constraints. In the representative configuration illustrated in FIGS. 1 and 2, the body portion 36 is of a semi-hourglass design, in that in one dimension the container is deeply contoured for ease of handling while in the other dimension the profile of the body portion is generally linear.

The threaded portion 32 engages a corresponding threaded portion on the inner surface of the knurled skirt 54 of the apertured dome 50. While these mating threaded portions are included in a preferred embodiment of the present invention, if it were desired to omit the refillability feature the apertured dome 50 could be bonded or otherwise secured to the container finish 31 in a non-removable fashion. Other possible configurations include the use of mating snap-on type connecting elements which may optionally permit removal of the dome for refillability.

In a preferred embodiment, the applicator element 40 consists of a sphere which is rotatably disposed within the confines of the container finish 31. The applicator element may be hollow or solid, and may have a generally smooth outer surface or may have an outer surface having some degree of texturing. The use of a spherical element permits omnidirectional use of the applicator, since the element will rotate in any direction with equal efficacy. Other element shapes may be utilized, such as, for example, cylindrical, ellipsoidal, etc., but such shapes may present functional limitations in that applicators of such shapes will only generally speaking rotate about a single axis. The applicator element may be either solid or hollow, but preferably has a comparatively smooth outer surface.

Figure 2:
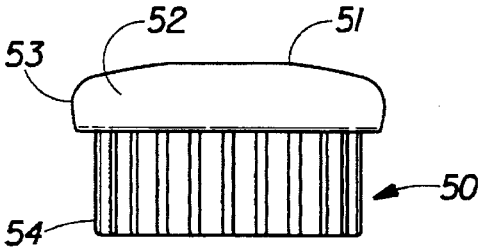
FIG. 2 is an elevational view of an apertured dome according to the embodiment of the present invention depicted in FIG. 1.
Figure 3:
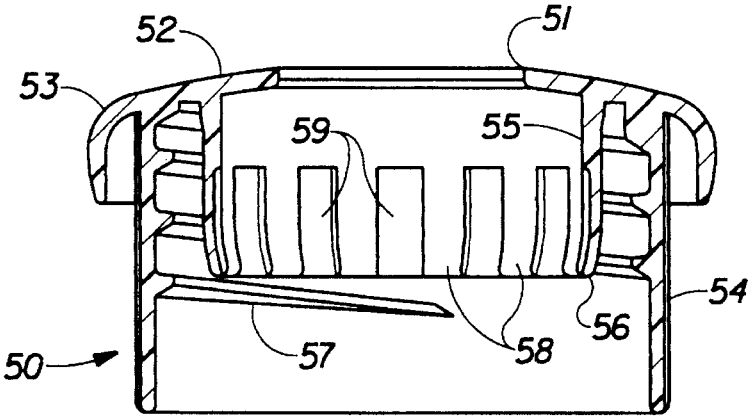
FIG. 3 is an elevational sectional view of the apertured dome of FIG. 2.

As shown in FIG. 1, the applicator 10 includes a dome 50, which provides the improved application/distribution attributes of the present invention. FIGS. 2 and 3 depict the features of the dome 50 in greater detail.

The dome 50 includes a generally centrally located aperture 51, which is sized and disposed so as to expose the desired portion of the surface area of the applicator element 40. The aperture 51 is laterally surrounded by a distribution surface 52 which extends both downwardly and radially outwardly from the aperture 51 to a generally rounded outer rim 53.

The dome 50 is secured to the container finish 32 by an outer skirt 54 which extends downwardly from the underside of the distribution surface 52. The outer skirt 54 preferably includes on its inner surface a means for engaging the container finish 32, such as threads, interlocking rings, beads, or grooves, or is provided with an adhesive or other means of securement.

The outer rim 53 is preferably rounded and extends downwardly and outwardly from the distribution surface 52 with a smaller radius of curvature than the distribution surface, and terminates at a location spread radially outwardly of the outer skirt 54. This insures that during use the distribution surface 52 (bounded by the outer rim 53) is the only portion of the applicator 10 other than the applicator element 40 which contacts the desired surface. Other possible configurations include those in which the outer rim 53 is substantially flush with the outer skirt 54. In such a configuration, it may be desirable to have the overcap 20 secured directly to the outer skirt 54 rather than to the container itself.

The dome 50 also preferably includes an inner skirt 55, as more clearly shown in FIG. 3, to define a socket bounded by the inner skirt 55 and the underside of the applicator dome 50 for capturing and retaining the applicator element 40. In a preferred embodiment wherein the applicator element 40 is spherical, the inner skirt preferably extends downward from the underside of the distribution surface 52 to the equatorial region of the applicator element 40, and then downwardly and radially inwardly such that the lowest edge 56 of the inner skirt 55 defines an opening having a smaller diameter than the maximum diameter of the applicator element. The inner skirt preferably has sufficient resiliency and/or is slotted so as to permit insertion of the applicator element, yet retains the applicator element under normal use conditions.

In order to provide the desired feature of refillability, the outer skirt 54 preferably includes threads 57 for engaging corresponding threads 32 on the container finish 31. Because the dome 50 preferably retains the applicator element 40 via the inner skirt 55, as described above, the dome 50 may be unthreaded from the container finish 32 to expose the open throat portion of the container 30. To further facilitate the grasping and turning of the dome 50, the outer skirt 54 preferably has a serrated or knurled outer surface as shown in FIG. 1.

Although in a preferred configuration the inner skirt 55 is configured so as to retain the applicator element 40, it may in some instances be desirable to shorten and/or widen the lower portion of the inner skirt 55 such that the applicator element is not captured within the socket defined by the inner skirt, but is instead loosely captured between the point seal 34, the inner skirt 55, and the underside of the applicator dome 50.

Figure 4:
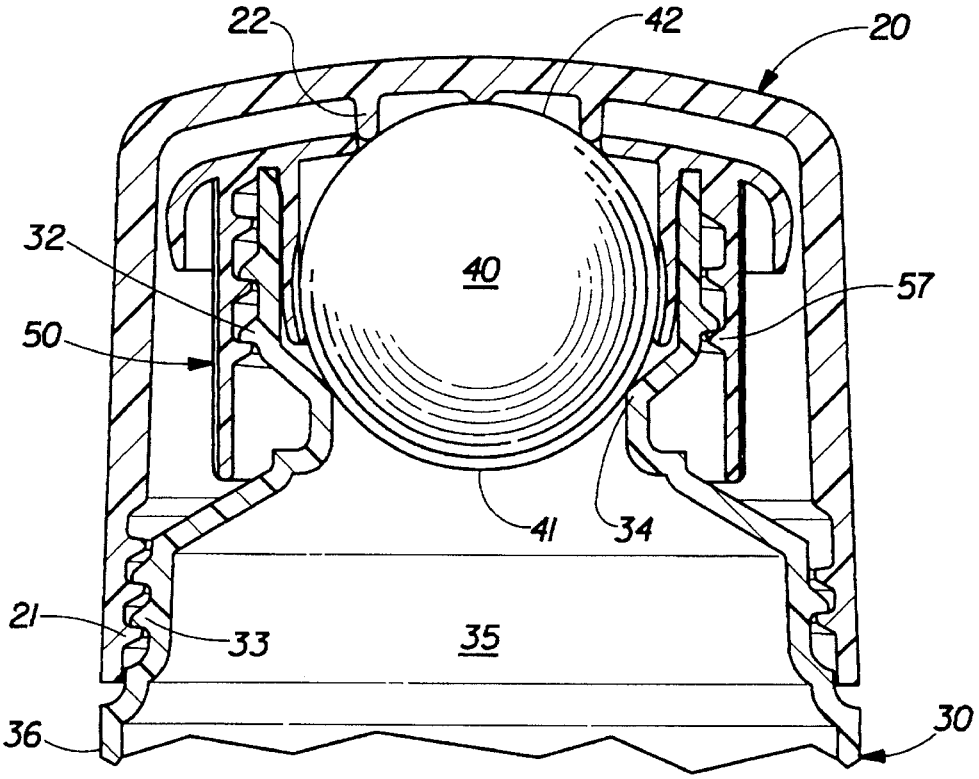
FIG. 4 is a fragmentary, enlarged, elevational sectional view of the embodiment of FIG. 1.

FIG. 4 is a sectional view of the applicator 10 according to the present invention, and more clearly depicts the relationship between the elements of the applicator in a fully assembled condition.

Two features of the dome 50, namely the aperture 51 and the inner skirt 55, in combination with the applicator element 40 perform the additional product metering function of the applicator 10. The aperture 51 and the outer surface of the element 40 are spaced apart to define a gap or clearance between them. The inner skirt 55 also has an inner diameter which is larger than the outer diameter of the applicator element 40 at any cross section, again creating a gap or clearance therebetween. These gaps or clearances allow a measured film of product to be brought up from the interior 35 of the container 30 on the surface of the applicator element 40 as it rotates within the confines of the dome.

To further aid in this metering process, the inner surface of the inner skirt 55 is preferably provided with a plurality of lands 58 and grooves 59. The grooves 59 (seen in FIG. 3) may be tailored to achieve the desired product flow while the lands prevent excessive play in the applicator element 40.

When the applicator element 40 is located within the confines of the applicator socket defined above, the clearances necessary to enable the element to rotate within the socket and to meter the product onto the surface of the element result in the element having a certain amount of free play or looseness within the socket. All of the clearances between the element 40 and other components of the applicator dome may be tailored to suit the particular product and the particular application rate or dosage desired.

In order to provide a seal to preserve unused product and prevent leakage from the applicator, the underside of the overcap 20 is preferably provided with a seal bead 22. As best seen in FIG. 4, the seal bead 22 is located so as to contact the applicator element 40 to force it downward against the point seal 34 as the overcap 20 advances downward onto the container 30, thus isolating the interior of the container with the unused product. Although the seal bead 22 may have any desired cross section, as shown in FIG. 4 the seal bead preferably has a rounded cross-section and preferably contacts both the applicator element 40 and the edge of the aperture 51, such that the gap between the applicator element 40 and the aperture 51 is effectively sealed. This provides a double seal, and added security against product leakage or degradation. An additional level of sealing protection is provided by the threaded engagement of the overcap 20 and the container 30.

An additional modification to improve the flow of products of relatively heavier consistences may include the provision of a series of grooves or gaps in the point seal 34, such that it no longer constitutes an uninterrupted surface for contacting the applicator element 40. Such grooves or gaps may generally resemble those depicted in FIG. 3 as grooves 59, and would permit additional flow and/or metering functions beyond those described above. As the addition of such grooves or gaps would cause a loss of sealing function of the point seal 34, the need for seal bead 22 to contact the element surface no longer exists and the seal bead 22 would preferably be relocated outward so as to contact the distribution surface 52 just outward of the aperture 51 for better sealing performance.

In use, the overcap 20 is removed and the applicator 10 is inverted, allowing the product within the container 30 to coat the inner exposed surface 41 of the applicator element 40 in a conventional manner. The applicator 10 is then brought toward the desired surface and the exposed outer portion 42 of the applicator element 40 is drawn across the surface, causing the applicator element to rotate within the socket portion of the applicator dome and draw a film of product having a predetermined thickness out of the container on the surface of the applicator element. Regardless of the attitude of the applicator during the application process, the clearances between the aperture and inner skirt and the applicator element will control the thickness of the product film on the element and prevent overapplication of product.

As product is expressed from the gap between the element and dome, it follows the surface of the element into contact with the desired surface and is thereby applied to this surface. As the applicator element is rolled across the desired surface, particularly if the surface has some resiliency, the distribution surface 52 will contact the surface to aid in distributing product applied by the applicator element. Excess product not applied to the desired surface by the element either follows the element surface through the gap between the element and the dome back into the container or is sheared from the element surface by the edge of the aperture in the dome. This sheared-off product flows onto the dome surface or contacts other parts of the desired receiving surface and is distributed by the application/distribution surface of the dome, which functions both as a secondary applicator for this undistributed product and as a primary distributor for evening out the total product distribution on the desired surface.

The improved roll-on applicator of the present invention may be utilized for applying a wide variety of products to a wide variety of surfaces. These products include anti-perspirants, deodorants, suntan lotions, depilatories, soaps, detergents, pre-treaters, etc. in fluid, suspension, lotion, cream, emulsion, or gel forms. Surfaces include various parts of the human anatomy, including the skin in general and underarms in particular, and fabric surfaces such as clothing and furniture. Products of the shear-thinning variety are believed to be particularly well-suited for use in the present invention, as their shear-thinning properties in combination with the additional distribution feature provided by the applicator dome result in a particularly effective application of these products. Of particular interest for use with the dispensers of the present invention are products of the anti-perspirant and deodorant variety.

To provide better overall distribution of product onto the receiving surface, the radius of curvature of the distribution surface 52 may be tailored to provide a complementary matching curved surface for maximum contact area. The exposed surface area of the rotating applicator element, the extent to which the element protrudes above the distribution surface, and the angle of intersection between the surface of the applicator element and the distribution surface may all be tailored to suit the natural curvature and/or resilience of the receiving surface and the characteristics of the product to provide optimized distribution of the product.

An exemplary embodiment of the present invention, for use with an antiperspirant having a viscosity of between about 500 and about 1300 cps at room temperature, was constructed having the construction details as follows. An apertured dome of generally circular configuration and approximately 1.750 inches diameter was constructed, with a centrally located aperture approximately 0.815 inches in diameter. The radius of curvature of the distribution surface of the dome was approximately 3.0 inches. A hollow spherical element having an outer diamater of approximately 0.998 inches was utilized. The inner surface of the inner skirt included 12 lands and 12 grooves, the grooves having a length of approximately 0.154 inches, a width of approximately 0.134 inches, and a depth of approximately 0.015 inches. In the assembled condition, without the overcap, the total element free play in the direction normal to the aperture was approximately 0.031 inches. This results a clearance or gap between the aperture and element of approximately 0.022 inches when the element is in contact with the point seal. The outer surfaces of the dome and element had a 24 charmille finish. The element protrusion distance above the edge of the aperture was approximately 0.150 inches, and the exposed portion of the element was approximately 0.470 square inches, or about 15% of the total element surface area. Conventional threaded connections were utilized to secure the dome to the container, and the point seals and the sealing bead were as depicted in the Drawing Figures.

The components of the improved dispensers of the present invention may be fabricated in any known manner, such as injection molding, blow molding, etc. The components may be formed of a wide variety of conventional materials, such as polyethylene, polypropylene, or other plastic materials, glass, metal, etc. Presently preferred materials for each of the components are polypropylene for the dome, overcap, and element, and polyethylene for the container. The presently preferred manufacturing processes are a combination of injection and blow molding for the container and injection molding for the overcap, dome, and applicator element. The container itself may be substantially rigid, as presently preferred, or may be deformable either resiliently or permanently (i.e., "tube-like"), depending upon the product and dispensing characteristics desired.

The connections between the overcap and the container, as well as between the applicator dome and the container, may have conventional mating threads, as presently preferred, or may have coupling features of other varieties, such as as reverse threads on the dome or the overcap, twist-lock-type connections, ¼ turn quick-disconnect type connections, snap-on connections, etc.

While the Drawing Figures and the foregoing discussion have focused on a preferred embodiment of the present invention having a single applicator element, under some circumstances and with certain types of products it may be desirable to provide multiple applicator elements with corresponding apertures in a single dome. It may likewise be desirable to add surface features or texturing to the dome surface to further aid in the distribution of the product to the receiving surface. Such texturing could include, for example, ridges, grooves, knobs, or even bristles.

While particular embodiments of the present invention have been illustrated and described, it would be obvious to those skilled in the art that various changes and modifications can be made without departing from the spirit and scope of the present invention. For example, the product composition, the size and shape of the overall dispenser, the size and shape of the application/distribution surface, the dimensions, ratios, clearances, and tolerances of the dispenser components, and the materials utilized may all be tailored to suit particular applications. It is intended to cover in the appended claims all such modifications that are within the scope of this invention.

What is claimed is:

1. An applicator adapted to contain and dispense a product, said applicator including a container comprising a body portion adapted to receive said product and having an upper portion which defines a dispensing opening, said applicator further comprising, in combination:

(a) an applicator dome having an outer skirt extending downwardly therefrom, said outer skirt adapted to engage said upper portion of said container, said applicator dome including an aperture disposed over said dispensing opening, said applicator dome further including an applicator socket in communication with said aperture and said dispensing opening, said applicator dome further including a non-dispensing distribution surface, said distribution surface surrounding and extending generally radially outwardly from said aperture to an outer rim, said outer rim terminates at a location spread radially outwardly of said outer skirt; and (b) an applicator element rotatably disposed within said applicator socket such that at least a portion of said applicator element is exposed through said aperture, said applicator element dispensing said product when said applicator element is rotated within said applicator, socket;

such that said distribution surface distributes said product dispensed by said applicator element.

2. An applicator according to claim 1, wherein said applicator further includes an overcap for enclosing said applicator dome and said applicator element during periods of non-use.

3. An applicator according to claim 2, wherein said applicator includes a point seal for engagement with said applicator element when said overcap is installed on said applicator during periods of non-use.

4. An applicator according to claim 3, wherein said point seal is interrupted by a plurality of grooves.

5. An applicator according to claim 4, wherein said overcap includes a seal bead for sealing engagement with said distribution surface when said overcap is installed on said applicator during periods of non-use.

6. An applicator according to claim 1, wherein said container is substantially rigid.

7. An applicator according to claim 1, wherein said container is deformable.

8. An applicator according to claim 1, wherein said distribution surface is generally circular in shape.

9. An applicator according to claim 1, wherein said applicator element is generally spherical in shape.

10. An applicator according to claim 1, wherein said product is selected from the group consisting of fluids, suspensions, lotions, creams, emulsions, gels, and mixtures thereof.

11. An applicator according to claim 1, wherein said distribution surface is contoured to match a receiving surface.

12. An applicator according to claim 1, wherein an angle between said applicator element and said distribution surface is selected to match a receiving surface.

13. An applicator according to claim 1, wherein said distribution surface is textured.

14. An applicator according to claim 1, wherein said applicator element is textured.

15. An applicator according to claim 1, wherein said applicator socket includes a plurality of lands and grooves for metering said product between said applicator element and said applicator socket.

16. An applicator adapted to contain and dispense a product, said applicator including a container comprising a body portion adapted to receive said product and having an upper portion which defines a dispensing opening, said applicator further comprising, in combination:

(a) an applicator dome having an outer skirt extending downwardly therefrom, said outer skirt adapted to engage said upper portion of said container, said applicator dome including an aperture disposed over said dispensing opening, said applicator dome further including an applicator socket in communication with said aperture and said dispensing opening, said applicator dome further including a non-dispensing distribution surface, said distribution surface surrounding and extending generally radially outwardly from said aperture to an outer rim, said outer rim terminates at a location spread radially outwardly of said outer skirt;

(b) an applicator element rotatably disposed within said applicator socket such that at least a portion of said applicator element is exposed through said aperture, said applicator element dispensing said product when said applicator element is rotated within said applicator socket, such that said distribution surface distributes said product dispensed by said applicator element, said applicator socket further including a plurality of lands and grooves for metering said product between said applicator element and said applicator socket;

(c) an overcap for enclosing said applicator dome and said applicator element during periods of non-use: and (d) said applicator further including a point seal for engagement with said applicator element when said overcap is installed on said applicator during periods of non-use;

such that said distribution surface distributes said product dispensed by said applicator element.

17. An applicator adapted to contain and dispense a product, said applicator including a substantially rigid container comprising a body portion adapted to receive said product and having an upper portion which defines a dispensing opening, said applicator further comprising, in combination:

(a) an applicator dome having an outer skin extending downwardly therefrom, said outer skirt adapted to engage said upper portion of said container, said applicator dome including an aperture disposed over said dispensing opening, said applicator dome further including an applicator socket in communication with said aperture and said dispensing opening, said applicator dome further including a generally circular non-dispensing distribution surface, said applicator socket being bounded by an underside of said distribution surface and by an inner skin that extends downward from said underside of said distribution surface, said distribution surface surrounding and extending generally radially outwardly from said aperture to an outer rim, said outer rim extends downwardly and outwardly from said distribution surface and terminates at a location spread radially outwardly of said outer skin;

(b) a generally spherical applicator element rotatably disposed within said applicator socket such that at least a portion of said applicator element is exposed through said aperture, said applicator element dispensing said product when said applicator element is rotated within said applicator socket, such that said distribution surface distributes said product dispensed by said applicator element, said applicator socket further including a plurality of lands and grooves for metering said product between said applicator element and said applicator socket;

(c) an overcap for enclosing said applicator dome and said applicator element during periods of non-use; and (d) said applicator further including a point seal for engagement with said applicator element when said overcap is installed on said applicator during periods of non-use;

such that said distribution surface distributes said product dispensed by said applicator element.

* * * * *